US006371130B1

(12) United States Patent
Vasas

(10) Patent No.: US 6,371,130 B1
(45) Date of Patent: Apr. 16, 2002

(54) VERSATILE MASCARA BRUSH WITH FEED GROOVE

(75) Inventor: Martin M. Vasas, Fairfield, CT (US)

(73) Assignee: The Bridgeport Metal Goods Manufacturing Company, Stratford, CT (US)

( * ) Notice: Subject to any disclaimer, the term of this patent is extended or adjusted under 35 U.S.C. 154(b) by 0 days.

(21) Appl. No.: 09/867,172

(22) Filed: May 29, 2001

(51) Int. Cl.[7] ..... A45D 40/26
(52) U.S. Cl. ..... 132/218; 132/317
(58) Field of Search ..... 132/218, 320, 132/317, 313; 401/122, 129; 15/206

(56) References Cited

U.S. PATENT DOCUMENTS 4,403,624 A * 9/1983 Montgomery ..... 132/218
4,628,950 A * 12/1986 Bitzer ..... 132/218
5,542,439 A * 8/1996 Gueret ..... 132/218
5,853,011 A * 12/1998 Gueret ..... 132/218
6,237,609 B1 * 5/2001 Basas ..... 132/218
6,279,583 B1 * 8/2001 Neuner ..... 132/218

* cited by examiner

*Primary Examiner*—Gene Mancene
*Assistant Examiner*—Robyn Kien Doan
(74) *Attorney, Agent, or Firm*—Ware, Fressola, VanDerSluys & Adolphson LLP

(57) ABSTRACT

A mascara brush has a twisted wire core with radially extending bristles trimmed to a generally cross-sectional triangular shape. The apex is truncated to form an application surface and a feed groove extends inwardly from the base of the triangular shape, opposite the application surface. First and second combing surfaces flank the feed groove. A first side surface joins the first combing surface at a sharp comb edge and joins the application surface at a first application edge. A second side surface joins the second combing surface at a second sharp combing edge and joins the application surface at a second application edge. The application surface may also be rounded. The core may be curved to provide a convex or concave application surface. The various surfaces and edges provide a very versatile mascara brush.

20 Claims, 4 Drawing Sheets

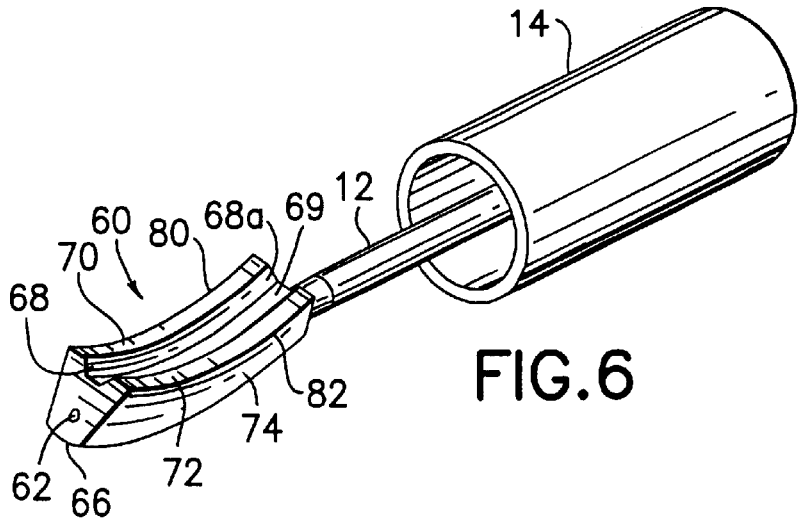
FIG.6
FIG.7
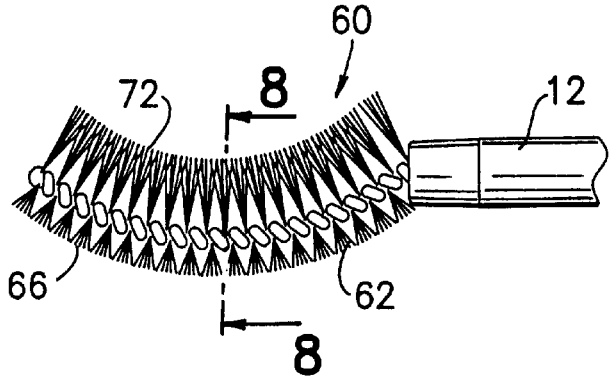
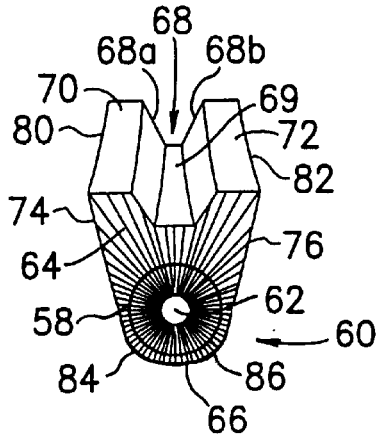
FIG.8

VERSATILE MASCARA BRUSH WITH FEED GROOVE

FIELD OF THE INVENTION

The invention herein relates to a mascara brush configured for versatile use in applying mascara.

BACKGROUND OF THE INVENTION

Mascara is generally applied with a brush. The brush is mounted on the distal end of an applicator rod extending from a cap. The cap closes an elongated bottle defining a mascara reservoir and containing the mascara. The bottle has a wiper in its neck, and when the cap is positioned to close the bottle, the applicator rod extends through the wiper so that the mascara brush is immersed in the mascara.

The mascara brush must perform several functions in applying mascara. It must accumulate mascara within the bottle, and carry mascara through the wiper where the excess mascara is removed. The mascara brush must then apply the mascara to the eyelashes, and is preferably capable of performing a curling or lifting function with respect to the eyelashes. The mascara brush must also be capable of combing and separating the eyelashes and spreading the mascara relatively evenly on the eyelashes. The mascara brush must be able to perform these functions comfortably on the eyelashes of both left and right eyes.

The functions are not totally independent, e.g., the functions of applying mascara and combing eyelashes and the functions of combing the eyelashes and spreading the mascara are often combined. It has been difficult to achieve all of these functions at a high level within a single mascara brush.

SUMMARY OF INVENTION

Accordingly, it is a principal object of the invention herein to provide a versatile mascara brush.

It is an additional object of the invention herein to provide a mascara brush that accepts and applies mascara product well.

It is a further object of the invention to provide a mascara brush with multiple surfaces and multiple edges formed where the multiple surfaces join, adapted to apply mascara, curl and lift eyelashes, comb and separate eyelashes and spread mascara.

It is also an object of the invention herein to provide a mascara brush which facilitates applying mascara to the eyelashes of both right and left eyelids.

In carrying out the foregoing objects of the invention, there is provided a mascara brush having an elongated core with a plurality of bristles extending generally radially outwardly from the core. The bristles are trimmed so that their outer ends form a brush surface. In a cross section taken through the core, the brush surface has a generally triangular configuration with product application performed by bristles at the apex. A feed groove is formed extending inwardly in the base of the generally triangular configuration, opposite the apex. First and second combing surfaces are formed on the base, flanking the feed groove. First and second side surfaces respectively extend from the first and second combing surfaces to the apex. The first side edge surface joins the first combing surface at one corner of the generally triangular configuration, forming a sharp comb edge of the mascara brush. Similarly, the second side surface joins the second combing surface at another corner of the generally triangular configuration, forming a second sharp comb edge.

First and second combing surfaces are formed flanking the feed groove. The feed groove. The feed groove retains mascara when the mascara brush is wiped, and supplies mascara to the combing surfaces. According to further aspects of the invention, the apex of the generally triangular shape is truncated to form an application surface. The first side edge joins the application surface, and may form an applicator comb edge or may smoothly transition with the applicator edge. The second side edge also joins the application surface at the truncated apex of the generally triangular configuration, forming a second applicator comb edge or alternatively smoothly transitioning therewith.

In accordance with other aspects of the invention, the feed groove is V-shaped, U-shaped, semi-circularly shaped, rectangularly shaped, or has another shape extending inwardly toward the core between the first and second combing surfaces.

In accordance with additional aspects of the invention, the core is offset toward the application surface of the brush. The core is fabricated of twisted wire gripping the bristles of the brush therebetween. The bristles are provided in a count of about 25 to 100 fibers per coil, a fiber forming two bristles and a coil consisting of a 180° turn of the twisted wire core. The bristles may be solid fiber bristles or hollow fiber bristles, preferably with a diameter in the range of 0.002–0.006 inches.

In accordance with another object of the invention, the core is substantially straight, and supports the application surface and combing surfaces in a generally straight configuration, generally along the axis of the core.

In accordance with still other objects of the invention, the core may be curved to support the application surface in a convex configuration and the first and second combing surfaces in a concave configuration, generally along the longitudinal axis of the core. Also according to the invention, the core may be curved to support the application surface in a concave configuration and the first and second combing surfaces in a convex configuration, generally along the axis of the core.

Other and more specific objects and features of the invention herein will in part be apparent to those skilled in the art and will in part appear in the following description of the preferred embodiments and claims, taken together with the drawings.

BRIEF DESCRIPTION OF DRAWINGS

FIG. 6 is a perspective view of another, curved mascara brush according to the invention herein, attached to an applicator rod and cap;

FIG. 7 is a side elevation view of the mascara brush of FIG. 6;

FIG. 8 is a cross sectional view of the mascara brush of FIG. 6, taken along the lines 8—8 of FIG. 7;

The same reference numerals refer to the same elements throughout the various Figures.

DETAILED DESCRIPTION OF PREFERRED EMBODIMENT

Figure 1:
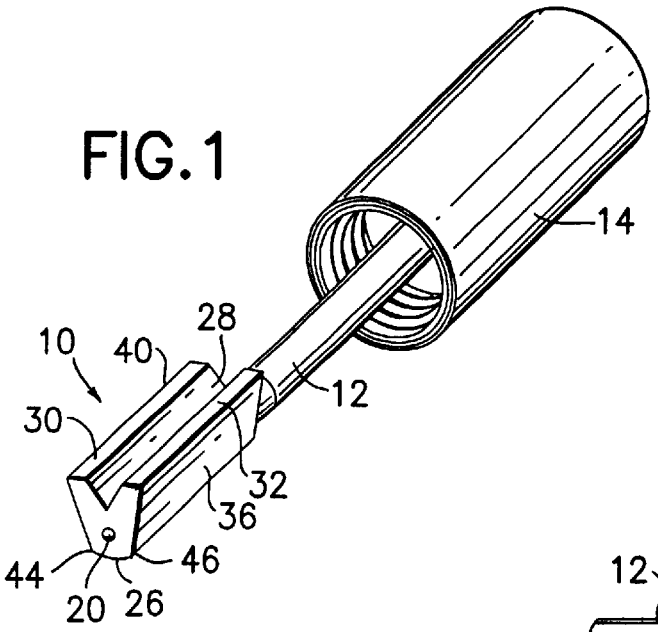
FIG. 1 is a perspective view of a mascara brush according to the invention herein, mounted on an applicator rod and cap.
Figure 2:
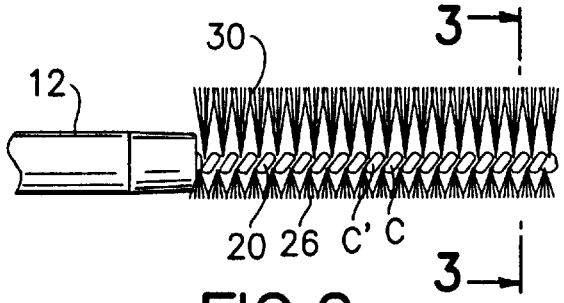
FIG. 2 is a side elevation view of the mascara brush of FIG. 1.
Figure 3:
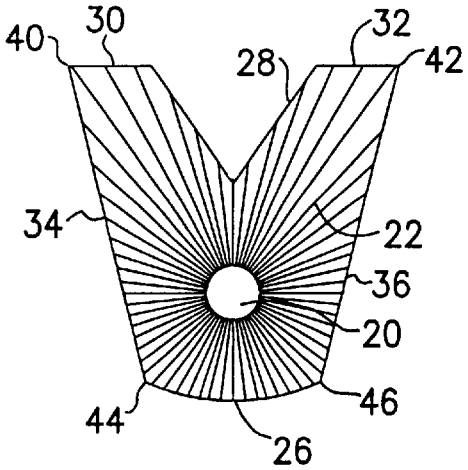
FIG. 3 is a sectional view of the mascara brush of FIG. 1, taken along the lines 3—3 of FIG. 2.

With reference to FIGS. 1–3, the first mascara brush 10 according to the invention herein is illustrated. The mascara brush 10 is mounted to and extends axially from an applicator rod 12 of the cap 14, which are part of a cosmetics container 16 shown in FIG. 4.

The brush 10 has a core 20 from which a plurality of bristles, generally indicated at 22, extend radially outwardly. In the mascara brush 10, the core 20 is straight and extends axially from the applicator rod 12.

The core 20 is formed of twisted wire in which individual fibers are captured. Each captured fiber forms two bristles extending outwardly from the core. The bristles are trimmed to define an outer surface of the brush, best seen in the FIG. 1 and the cross section of FIG. 3.

The outer surface of the brush 10 has a generally triangular configuration, which is inverted in the figures with the apex of the triangular configuration pointing downwardly and the base of the triangular configuration at the top of the figures. The apex of the generally triangular configuration is truncated, to form a mascara application surface 26, which extends along the length of the brush generally parallel to the core 20. The mascara application surface is preferably slightly rounded across its width, as shown in FIG. 3.

A feed groove 28, which is V-shaped in the brush 10, is formed extending inwardly from the base of the generally triangular configuration, opposite the mascara application surface 26. The remainder of the base of the generally triangular configuration brush forms a first combing surface 30 and a second combing surface 32, which also extend along the length of the brush 10, as best seen in FIG. 1.

The generally triangular configuration of brush 10 also includes a first side surface 34 and a second side surface 36, respectively extending from the first combing surface 30 to the mascara application surface 26 and from the second combing surface 32 to the mascara application surface 26. The first side surface 24 joins the first combing surface 30 to form a first sharp comb edge 40, and the second side surface 36 joins the second combing surface 32 at a second sharp comb edge 42. The first side surface 34 joins the application surface 26 at a first application edge 44, and the second side surface 36 joins the product application surface 26 at a second application edge 46.

It will be noted that the core 20 is asymmetrically positioned in the generally triangular configuration of the brush 10, being substantially closer to the mascara application surface 26 than to the first and second combing surfaces 30 and 32. In general, the combing surfaces 30, 32 may be approximately twice as far from the core as the application surface 26. Thus, the bristles which have their ends defining the application surface 26 are shorter and exhibit relatively more stiffness, as they are among the shorter bristles of the brush. The bristles defining the first and second combing surfaces 30, 32 are relatively longer and more flexible.

In the embodiment shown, the bristles are 0.005 inch diameter hollow fibers. Other diameters may be used. The fibers are preferably provided in a density of about 50 fibers per coil, and a range from about 40–70 fibers per coil provides a satisfactory brush. In general, more fibers are used if the fibers are thin, and less fibers are used if the fibers are thicker. Thus, the range of the number of fibers per coil can be 25 to 100 or more. As noted above, each fiber is held in the twisted wire core 20, and forms two bristles. With particular reference to FIG. 2, the term "coil" as used herein is one loop of the twisted wire core as viewed from the side, with adjacent coils C and C' marked on the drawing. The brush has a width of 0.310 inches from sharp edge 40 to sharp edge 42, and a height of 0.310 inches from the combing surfaces 30, 32 to the application surface 26. The feed groove 28 is 0.155 inches wide and 0.110 inches deep. These dimensions are provided as an example of a preferred brush, but are not intended to be limiting, as the dimensions and overall sizes may be varied to provide other very satisfactory brushes.

As noted above and shown in FIG. 4, the mascara brush 10 is part of a cosmetics container 16. The cosmetics container includes a bottle 50 defining a reservoir 52 therein for containing mascara. The bottle 50 has a threaded neck 54 with a wiper 56 mounted therein. The wiper 56 defines a circular wiper orifice 58. The diameter of the wiper orifice is preferably slightly smaller than the diameter of the rod, which is 0.175 inches in the embodiment shown. The cap 14 fits over the threaded neck 54, with the applicator rod 12 extending through the wiper orifice, supporting the brush 10 in the reservoir 52 where it collects mascara.

Figure 4:
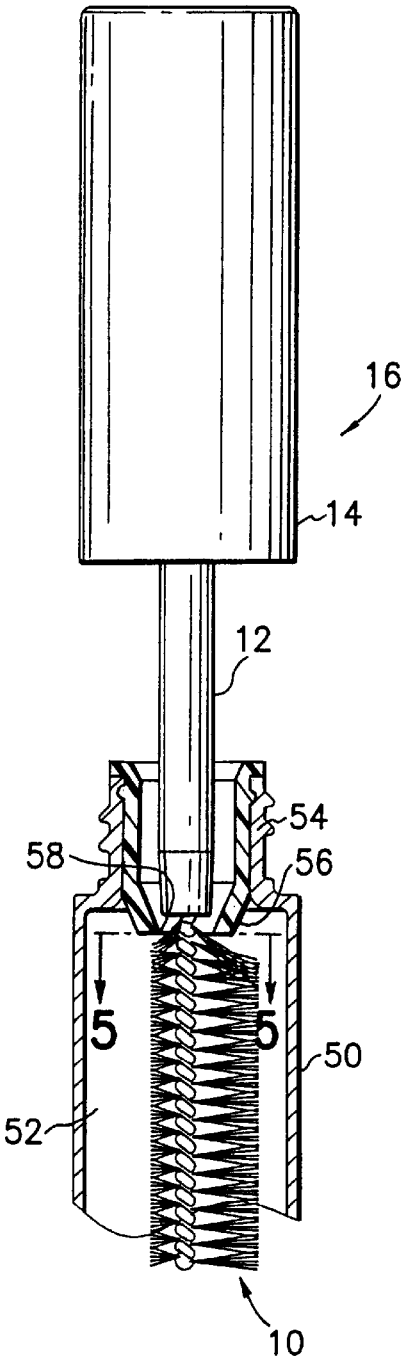
FIG. 4 is a side elevation view, partially in section and partially cut away, of a cosmetics container incorporating the mascara brush of the invention herein, with the mascara brush being withdrawn through a wiper of the container.
Figure 5:
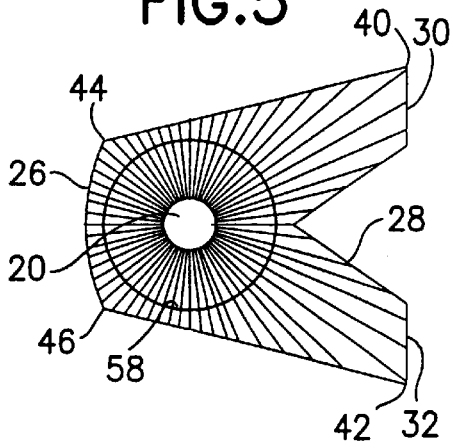
FIG. 5 is a sectional view of the mascara brush and wiper orifice, taken along the lines 5—5 of FIG. 4.

As shown in FIGS. 4 and 5, the brush 10 is being withdrawn from the product reservoir 52, and engages the wiper 56 for removing excess mascara. In part because the shorter bristles defining the application surface 26 are more difficult to deflect or bend than the longer bristles forming the combing surfaces 30, 32, the core 20 assumes a generally central position within the wiper orifice 58 as the mascara brush 10 is withdrawn from the reservoir 52. This is illustrated in both FIG. 4 and FIG. 5, the position of the wiper orifice 58 being superimposed on the cross-sectional view of brush 10 in FIG. 5. Thus, the bristles defining the application surface 26 are less deflected as they pass through the wiper orifice, and a relatively large amount of product is carried with the brush in these bristles as the brush is withdrawn from the reservoir 52. This provides a substantial supply of mascara available closely adjacent the application surface, making it well adapted for the primary application of mascara product.

The bristles defining the first and second combing surfaces 30 and 32 are more greatly deflected as they pass through the wiper orifice and are correspondingly wiped more cleanly of excess mascara, making these surfaces appropriate for spreading and combing the eyelashes.

However, it is also found that due to the configuration of the brush 10, a supply of mascara accumulates in the feed groove 28 during wiping. The mascara accumulated in the feed groove 28 functions to maintain the bristles defining the combing surfaces 30, 32 in a moistened condition, i.e., it prevents the mascara from drying out on these surfaces, and further may apply a thin additional coat of mascara as the combing surfaces 30 and 32 are utilized.

The mascara brush 10 is used in the following manner. After it is withdrawn from the reservoir 52, the application surface 26 may be used to apply a substantial amount of mascara to eyelashes. One or both of the first and second application edges 44 and 46 may be used to lift and curl the eyelashes, and the proximity of the applications edges to the application surface 26 generally provides for continued application of mascara during the lifting and curling process.

Thereafter, one or both of the first and second combing surfaces 30, 32 may be utilized to spread and smooth the mascara. Because of the mascara in the feed groove 28, the combing surfaces 30 and 32 are maintained moist and do not dry and flake the mascara product during combing. An amount of additional mascara application may occur during this combing process. Next, one or both of the sharp comb edges 40, 42 may be used to separate the eyelashes and provide a final combing action.

It will be appreciated that it may be convenient for the user to employ various ones of the first and second application edges, first and second combing surfaces and first and second sharp comb edges when applying mascara to one eye, and that other of those surfaces and edges may be more conveniently employed when applying mascara to the other eye. It will also be appreciated that with the variety of surfaces and edges available to the user, the user may develop various procedures and uses for them.

Therefore, the mascara brush 10 is extremely versatile in its operation, having an application surface that carries a good supply of mascara for application, application edges for lifting and curling, two combing surfaces for spreading, smoothing and combing, a feed groove to keep the combining surfaces moist and for applying additional mascara, and two comb edges for final separation and combing, all adapted for use with either hand on either eye.

FIGS. 6–9 illustrate another mascara brush 60 according to the invention herein. The mascara brush 60 is shown mounted on the end of applicator rod 12 extending from cap 14, and may be used with the bottle 50 and wiper 56 illustrated in FIG. 4.

The mascara brush 60 has a core 62 which is curved, as best seen in FIG. 7. The core 62 is preferably formed of twisted wire which holds bristles, generally indicated at 64, extending outwardly therefrom. The mascara brush 60 also has its bristles 64 trimmed to provide a generally triangular configuration when viewed in cross section, as seen in FIGS. 6 and 8.

The brush 60 also has a truncated apex forming an application surface 66; however, the truncation of brush 60 is rounded to provide an application surface that is substantially semi-circular when viewed in section. The core 62 is curved, wherein the application surface 66 is convex along its length.

Opposite the application surface 66 is a feed groove 68 which has tapered side walls 68*a* and 68*b* joined by a flat bottom 69. The feed groove 68 is positioned between first and second combing surfaces 70 and 72. The feed groove 68 and the first and second combing surfaces 70 and 72 follow the curve of the core 62, and are therefore concave along their lengths.

The mascara brush 60 also has first and second side surfaces 74 and 76. The first side surface 74 joins the first combing 70 at a sharp comb edge 80, and the second side surface 76 joins the second combing surface 72 at a second sharp comb edge 82. The first side surface 74 joins the application surface 66 at a first smooth transition area 84, and the second side surface 76 joins the application surface 66 at a second smooth transition area 86.

The mascara brush 60 is used in a manner similar to the mascara brush 10 described above, with the brush providing versatility in its various surfaces and edges, and enhanced by the feed groove feature. Because the mascara brush 60 is curved with the application surface 66 concave along its length, the bristles of the application surface are somewhat spread allowing greater access to the product collected adjacent the tips of these bristles, whereby the brush 60 is suitable for applying relatively heavy coatings of mascara. The smooth transition areas 84 and 86 also extend the surface area devoted to application, also adapting brush 60 for applying relatively heavy coatings of mascara. Because the combing surfaces 80 and 82 are concave along their length, the bristles defining the combing surfaces 70 and 72 converge and provide a dense surface which is useful in spreading the mascara, and does not apply substantial additional amounts of mascara. The sharp combing edges 80, 82 may then be used to separate the eyelashes.

Figure 9:
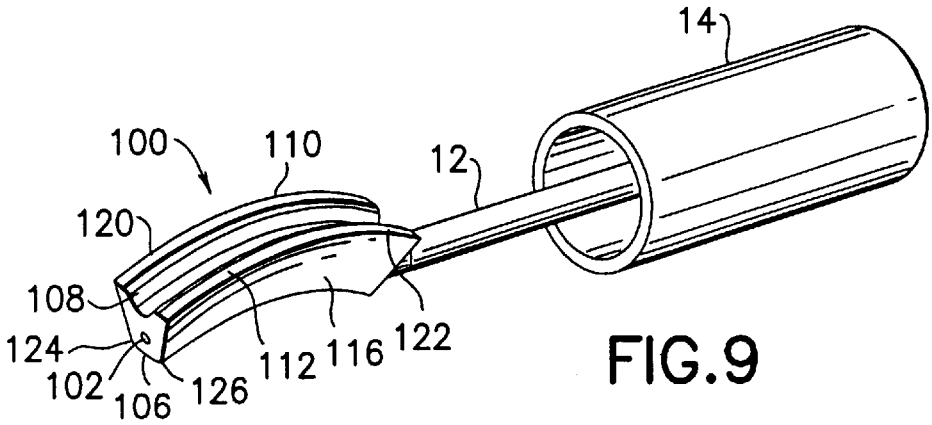
FIG. 9 is a perspective view of another, curved mascara brush according to the invention herein, attached to an applicator rod and cap.
Figure 10:
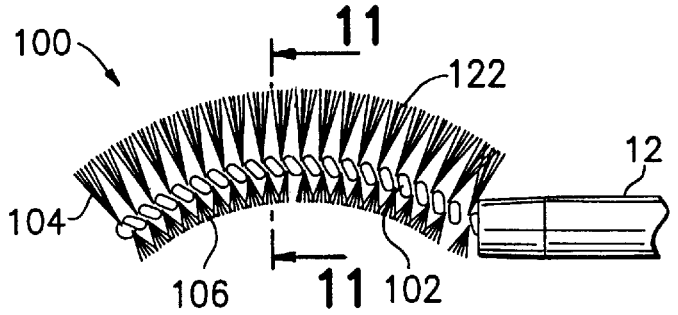
FIG. 10 is a side elevation view of the mascara brush of FIG. 9.
Figure 11:
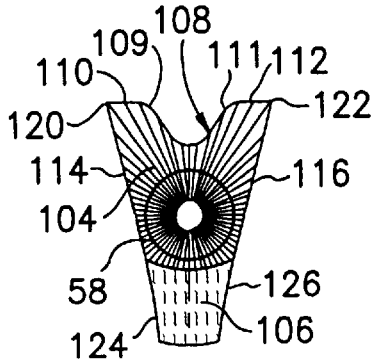
FIG. 11 is a cross sectional view of the mascara brush of FIG. 9, taken along the lines 11—11 of FIG. 10.

FIGS. 9–11, another mascara brush 100 according to the invention herein is shown. The mascara brush 100 is mounted on applicator rod 12 extending from cap 14, and may be used with the bottle 50 and wiper 56 shown in FIG. 4 to form a complete cosmetics container. The mascara brush 100 has a core 102 and a plurality of bristles generally indicated at 104 extending generally radially outwardly from the core 102.

As with the mascara brushes 10 and 60 described above, the bristles 104 are trimmed to provide a substantially triangular configuration of the outer surface of the brush when viewed in cross section, as shown of FIG. 11. The bristles of the mascara brush 100 define an application surface 106 at the truncated apex of the generally triangular shape, and define a feed groove 108 generally opposite the application surface 106. The feed groove 108 extends inwardly toward the core 102 and has a rounded bottom, thus having a U-shaped or a semi-circular shape. Flanking the feed groove 108 are first and second combing surfaces 110 and 112, and the transition between the combing surfaces 110, 112 and the feed groove 18 may be rounded, as shown at 109 and 111.

First side surface 114 extends between a first sharp comb edge 120 formed at the intersection with the first combing surface to a first application edge 124 formed at the junction of the first side surface 114 and the application surface 106. The second side surface 116 of the brush 110 extends between the second sharp comb surface 122 and a second application edge 126.

The core 102 is offset toward the application surface 106, which is thereby defined by shorter bristles, and with reference to FIG. 11, the wiper orifice 58 is schematically shown on the sectional view to indicate how the mascara brush 110 is wiped. As with the brushes 10 and 60 described above, this wiping action leaves more mascara in the area of the application surface 106, while the bristles defining the combing surfaces 110, 112 are more clearly wiped. The feed groove 108 contains a supply of mascara after wiping.

The mascara brush 100 is also characterized by having a curved core, with the bristles defining the application surface 106 are concave along the length of the core 102 and the bristles defining the comb surfaces 110 and 112 are convex side along the length of the core 102. This configuration is well adapted for use with lightweight or low viscosity mascara products.

The mascara brush 100 is used in a similar manner to the mascara brushes 10 described above, being inserted into the product reservoir 42 of bottle 50 to accumulate mascara and being withdrawn through the wiper orifice 58 to remove excess mascara. The mascara brush is then used to apply and spread the mascara, and to lift and curl, comb and separate the eyelashes, utilizing the various surfaces and edges of the mascara brush 100. The feed groove 108 tends to retain more mascara than the adjacent combing surfaces 110, 112 as the mascara brush is withdrawn through the wiper orifice, and provides a source of mascara to the combing surfaces 110, 112 for keeping them moist and for utilizing them to apply additional mascara. Because the bristles of the combing surfaces 110, 112 diverge, the eyelashes can more easily penetrate the brush surface and pick up additional mascara. It will be further appreciated that the various combing surfaces and edges adapt the mascara brush 100 for use with either hand and for applying mascara to the eyelashes of either eyelid.

Accordingly, there have been described very versatile mascara brushes which admirably achieve the objects of the invention herein. It should be appreciated that the foregoing description of the preferred embodiments is not intended to be limiting, but is illustrative of mascara brushes according to the invention. The proportions of the generally triangular cross-sectional shape and the sizes of the application surfaces and combing surfaces may be varied, e.g., the surfaces can be flat, slightly rounded, canted, or the like. Also, the configuration of the feed groove is illustrative, and can be varied as well. The type and number of bristles and the type and winding of the core can also be varied, particularly to accommodate mascaras of varying viscosity or other properties. Accordingly, the scope of the invention is limited only by the following claims.

I claim:

1. A mascara brush comprising:

A) an elongated core;

B) a plurality of bristles extending generally radially outwardly from the core, the bristles trimmed so that their outer surfaces form a brush surface; and C) the brush surface having a generally triangular shape viewed in cross section taken through the core, wherein the brush has a) an apex of the generally triangular shape adapted to apply mascara and extending along the brush, b) a feed groove formed extending inwardly from the base of the generally triangular shape, opposite the apex, and extending along the brush, c) first and second combing surfaces formed on the base of the generally triangular shape, flanking the feed groove and extending along the brush, d) first and second side surfaces of the generally triangular shape, respectively extending from the first and second combing surfaces to the apex, e) the first side surface joining the first combing surface at a sharp comb edge and the second side surface joining the second combing surface at a second sharp comb edge.

2. A mascara brush as defined in claim 1 wherein the apex of the generally triangular is truncated to form an application surface extending along the brush.

3. A mascara brush as defined in claim 2 wherein the application surface joins the first side surface at a first application edge and the application surface joins the second side surface at a second application edge.

4. A mascara brush as defined in claim 2, wherein the application surface is rounded and joins the first and second side surfaces at rounded transitions.

5. A mascara brush as defined in claim 2 wherein the core is offset toward the application surface, whereby the bristles forming the application surface are shorter than the bristles forming the first and second combing surfaces.

6. A mascara brush as defined in claim 5 wherein the core is substantially straight along its length.

7. A mascara brush as defined in claim 5 wherein the core is curved along its length, supporting the application surface in a convex configuration along its length.

8. A mascara brush as defined in claim 7 wherein the core is curved along its length, supporting the application surface in a concave configuration along its length.

9. A mascara brush as defined in claim 5 wherein the feed groove has a V-shaped configuration.

10. A mascara brush as defined in claim 5 wherein the feed groove has a rounded, generally semi-circular configuration.

11. A mascara brush as defined in claim 10 wherein the respective transitions between the feed groove and the first and second combing surfaces are rounded.

12. A mascara brush as defined in claim 5 wherein the feed groove has a flat bottom along its length.

13. A mascara brush as defined in claim 5 wherein the feed groove has a depth of about one-half the length of the bristles defining the first and second combing surfaces.

14. A mascara brush as defined in claim 1 wherein the core is a twisted wire core.

15. A mascara brush as defined in claim 14 wherein the bristles are formed of hollow fiber.

16. A mascara brush as defined in claim 15 wherein the hollow fiber bristles have a diameter in the range of about 0.004 inches to 0.006 inches.

17. A mascara brush as defined in claim 16 wherein the hollow fibers forming the bristles are provided in a density of about 40–70 fibers per 180° coil of the twisted wire core.

18. A mascara brush as defined in claim 14 wherein the fibers forming the bristles have diameter in the range of 0.002 inches to 0.006 inches.

19. A mascara brush as defined in claim 18 wherein the fibers forming the bristles are provided in density of approximately 25–100 fibers per 180° coil of twisted wire core.

20. A mascara brush comprising

A) an elongated twisted wire core;

B) a plurality of hollow fibers captured by the twisted wire core provided in a range of about 25–100 fibers per 180° turn of the twisted wire core, to form a plurality of bristles extending generally radially outwardly from the twisted wire core; and C) the bristles being trimmed so that their outer ends form a brush surface having a generally triangular shape viewed in cross-section taken through the core of the, wherein the brush has a) a truncated apex forming an application surface extending along the brush and adapted to apply mascara, the core of the brush being offset toward the application surface, b) a feed groove extending inwardly from the base of the generally triangular shape, opposite the application surface, the feed groove having a depth extending about halfway from the surface of the brush to the core, c) first and second combing surfaces formed on the base of the generally triangular shape flanking the feed groove, and extending along the brush, d) first and second side surfaces of the generally triangular shape, respectively extending from the first and second combing surfaces to the application surface, e) the first side surface joining the first combing surface at a sharp comb edge and the second side surface joining the second combing surface at a second sharp comb edge, and f) the first side surface joining the application surface at a first application edge and the second side surface joining the application surface at a second application edge.

* * * * *